United States Patent [19]

Williams

[11] Patent Number: 4,493,121

[45] Date of Patent: Jan. 15, 1985

[54] BLANKET LIFTING DEVICE

[76] Inventor: Frank Williams, 1323 Whitney Bank Bldg., New Orleans, La. 70130

[21] Appl. No.: 489,479

[22] Filed: Apr. 28, 1983

[51] Int. Cl.[3] ..... A47C 21/00

[52] U.S. Cl. ..... 5/505; 5/414; 248/328; 29/448

[58] Field of Search ..... 5/503–506, 5/414, 498, 121, 122, 127, 128; 135/90, 96; 52/83; 248/328, 332; 29/448

[56] References Cited

U.S. PATENT DOCUMENTS

| | | | |
|---|---|---|---|
| 252,769 | 1/1882 | Howe | 135/90 |
| 649,900 | 5/1900 | Brennan | 5/505 |
| 649,901 | 5/1900 | Brennan | 5/505 |
| 861,034 | 7/1907 | Kelly | 135/90 |
| 1,112,514 | 10/1914 | Zimmermann | 5/505 |
| 1,688,624 | 10/1928 | Kanter | 5/498 |
| 3,026,079 | 3/1962 | Stack | 5/503 |
| 4,214,327 | 7/1980 | Smith | 5/504 |

FOREIGN PATENT DOCUMENTS

| | | | |
|---|---|---|---|
| 154551 | 5/1956 | Sweden | 5/505 |

*Primary Examiner*—Alexander Grosz
*Assistant Examiner*—Michael F. Trettel
*Attorney, Agent, or Firm*—Dula, Shields & Egbert

[57] ABSTRACT

A device for keeping a blanket or sheet off feet in a bed comprising a frame, a support structure, and a line extending from the frame and engaging the blanket. The support structure is a plate interposed between a mattress and a box spring set. The frame has a vertical member attached to the support structure which extends upwardly and generally perpendicular to the mattress. A horizontal member is attached to extends from the other end of the vertical member. A line is attached at one end to the horizontal member and at the other end to the blanket. The line includes a pin at one end. The blanket has a button occurring at a location corresponding to the location of the feet. The horizontal member has a well for receipt of the pin of the line.

3 Claims, 3 Drawing Figures

BLANKET LIFTING DEVICE

FIELD OF THE INVENTION

The present invention relates to methods and apparatus for keeping blankets and sheets suspended above and out of contact with the feet of a person in bed.

BACKGROUND ART

There are many situations where it is desirable to prevent a blanket from touching the feet of a person in bed. For example, people who have frostbitten or severely burned feet should not have their feet touching the blanket or sheet. In addition, it is well known that people have a tendency to cross their legs when a blanket or sheet is resting on top of their feet. This poses a common problem among elderly persons where the crossing of the legs cuts off vital circulation to their feet. These and a variety of other situations present the need for a device for suspending a blanket or sheet above the feet of a person in bed.

Previous methods employed by hospitals have proved woefully inadequate. One technique has been the employment of a metal frame which extends directly over the feet of the person in bed. The blanket or sheet is then draped over this metal frame and, thus, over the feet of the person. This arrangement, however, is inadequate since slight movements of the bed-ridden person will cause his or her feet to contact the metal support rods of this frame. Any contact with such a hard surface would be very painful to people suffering the symptoms as stated above. Also, if the metal rods of this framework were suspended high enough above the feet of the person in bed, then the thermal insulating qualities of the blanket are negated.

Heretofore all efforts to prevent the blanket or sheet from touching the feet of the person in bed have either presented potential painful consequences to the person, or have resulted in loss of the insulating characteristics of blanket use.

DISCLOSURE OF INVENTION

The present invention is a device for keeping a sheet or blanket off the feet of a person in bed comprising a frame, a support structure for maintaining the frame in a stationary position, and a line extending from the frame so as to engage the sheet or blanket on the bed. This device is used in combination with a mattress and box spring arrangement.

The support structure is a flat base member which is generally interposed between the mattress and the box spring set. This flat base member is rigidly fastened to the frame so as to maintain the frame in a proper upright position in relation to the mattress and box spring set.

The frame includes a vertical member with one end attached to one end of the flat base member. This vertical member extends upwardly and generally perpendicular to the plane of the mattress. A horizontal member is rigidly fastened and extends from the other end of the vertical member. This horizontal member extends generally parallel to and above the mattress. A diagonal strut connects the vertical member and the horizontal member for proper structural support.

The line is attached at one end to the horizontal member and at the other end to the sheet or blanket. The line has a length and strength sufficient to maintain the sheet or blanket in a position generally above the feet of the person in bed. The line includes a pin attached at one end. The sheet or blanket has a button positioned at a location generally corresponding to the location of the feet of the person in bed. The pin on the line is received by a well within the horizontal member. This well occurs at the end opposite to the point of connection between the horizontal member and the vertical member of the frame. The line engages the button on the blanket so as to cause the blanket to be drawn upward upon a pulling of the line. The line maintains the blanket or sheet a desired distance above the feet of the person in bed.

The present invention also includes a method of keeping a blanket or sheet off the feet of a person in be comprising the steps of:

(1) fastening one end of a line to a hole in the pin;
(2) fastening the other end of the line to a horizontal member extending generally above and parallel to the bed;
(3) threading the pin and the line through a point on the blanket or sheet generally corresponding to the location of the feet;
(4) drawing the thread and the blanket or sheet generally upwardly above the location of the feet; and
(5) inserting the pin into a receptacle on the horizontal member such that the blanket is maintained in a position out of contact with the feet.

This method also includes the steps of placing a button about the blanket and threading the line through the holes in the button so as to lift the blanket above the feet of the person in bed.

It is an object of the present invention to provide an apparatus and method for lifting a blanket or sheet upwardly so as to be out of contact with the feet of a person in bed.

It is another object of the present invention to provide a device which removes the blanket or sheet from contact with the feet while maintaining the insulating qualities of the blanket or sheet.

These and other objects and advantages of the present invention will become apparent from a reading of the attached specification and appended claims.

BEST MODE FOR CARRYING OUT THE INVENTION

Figure 1:
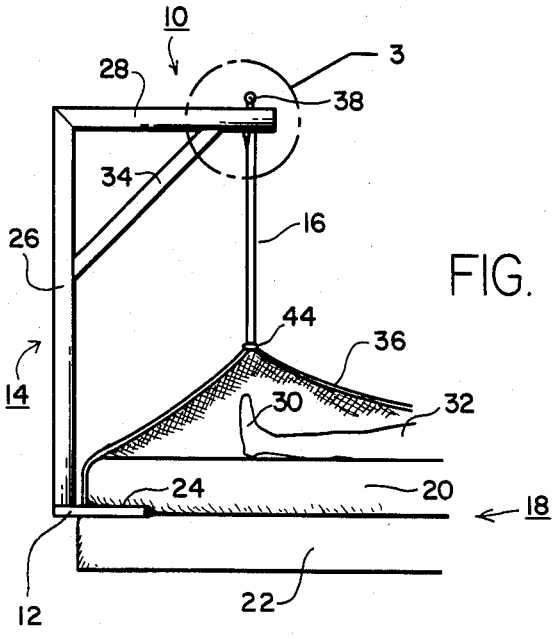
FIG. 1 is a side elevational view of the device according to the present invention.

Referring to FIG. 1, there is shown at 10 a device for keeping a sheet or blanket out of contact with the feet of a person in bed. Specifically, in FIG. 1, there is shown the support structure 12, the frame 14, line 16, and bedding arrangement 18.

Support structure 12 is a base plate interposed between mattress 20 and box spring set 22. The support structure is maintained in its proper position by the force of the weight of the mattress resting upon the flat surface 24 of the support structure.

Frame 14 is rigidly affixed to the end of support structure 12 extending beyond mattress 20 and box spring set 22. Frame 14 may be welded, riveted or otherwise permanently fastened to support structure 12. A generally vertical member 26 extends upwardly from support structure 12. Vertical member 26 is generally perpendicular to the plane of mattress 20. At the other end of vertical member 26 is a horizontal member 28. Horizontal member 28 extends inwardly and generally parallel to mattress 20. Horizontal member 28 should be located a sufficient distance above mattress 20 so as to avoid any contact with the feet 30 of the person 32 in bed. A diagonal strut 34 connects vertical member 26 with horizontal member 28. Diagonal strut 34 is fastened at one end to the end of horizontal member 28 and is generally attached at its other end to the midpoint of vertical member 26. Diagonal strut 34 serves to provide structural support for horizontal member 28 and line 16 extending therefrom.

Figure 3:
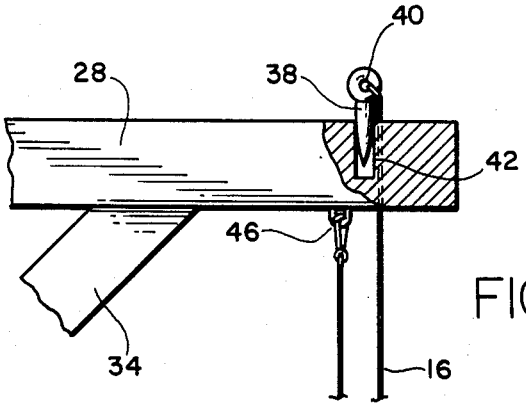
FIG. 3 is a view taken across lines 3—3 of FIG. 1 of the present invention.

Line 16 is a generally thread-like string extending from the end of horizontal member 28 downwardly so as to engage blanket 36. For the purposes of literary convenience, the term "blanket" is construed herein to be synonymous with the term "sheet". There is no intention herein to limit the scope of the patent to just blankets. Line 16 has at its one end a pin 38. Pin 38, as more clearly shown in FIG. 3, has a pin hole 40 through which line 16 passes and is attached. Pin 38 is received by the receptacle 42 incorporated into the body of horizontal member 28 of frame 14. Pin 38 is of sufficient size and quality so as to be removably fastened within well 42. Blanket 36 includes a button 44. Button 44 is located at a spot generally corresponding to the location of feet 30 of the person 32 in bed. Button 44 may be either affixed to blanket 36 or may be temporarily maintained in this position through the fastening of line 16, as needed. At its other end, line 16 may be clipped to, tied in a knot to, or otherwise attached to horizontal member 28. A clipped arrangement 46 is generally shown in FIG. 3.

The operation of the present invention includes a number of steps. First, the support structure 12 and frame 14 are positioned between mattress 20 and box spring set 22. In this manner, the general arrangement 10 is maintained in its proper position in relation to the patient. Next, line 16 is fastened to pin 38. This may be accomplished by looping line 16 through the pin hole 40 on pin 38. The other end of the line 16 is suitably fastened to horizontal member 28. The pin is then drawn through blanket 36 and through the holes on button. Once this is accomplished, the blanket may be drawn upwardly by pulling pin 38 upwardly. When the blanket has been lifted a sufficiently safe distance above feet 30, the pin is placed into receptacle 42 and the blanket is maintained in this position.

When it is desired to lower the blanket, the other end of the line 16 may be untied or unfastened from the horizontal member 28 and passed through the blanket and the button.

Through this method, the blanket is maintained a safe distance above the feet of the patient in bed. The blanket is maintained in this position without the use of an obstructing metal rod. Also, the thermal and insulating qualities of the blanket are maintained since the blanket is maintained in generally close proximity to the feet.

Figure 2:
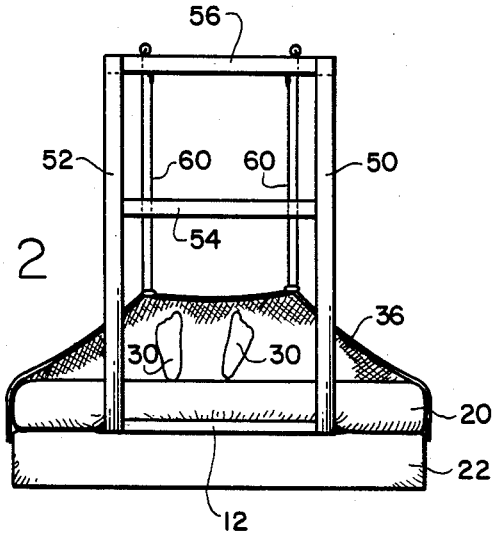
FIG. 2 is a end view of an alternative embodiment of the present invention.

An alternative embodiment of the present invention is shown in FIG. 2. This alternative embodiment shows a different arrangement for the framework structure of this device. Specifically, this shows a pair of lines extending from a wider frame structure.

FIG. 2 shows support structure 12 interposed between mattress 20 and box spring set 22. A pair of members 50 and 52 extend upwardly from the corners of support structure 12 extending beyond mattress 20. A tie rod 54 connects member 50 with member 52. Tie rod 54 serves as structural support for this arrangement. Members 50 and 52 are generally L-shaped members, each of which is shaped like the frame 14 of FIG. 1. A cross member 56 extends between the vertical members 50 and 52. Cross member 56 fastens to members 50 and 52 at the end of the L-shape. Cross member 56 adds structural support between these two members 50 and 52.

This embodiment employs a pair of lines 60 to support blanket 36 above feet 30 of the person in bed. As before, these lines attach to buttons about blanket 36 and are fastened to a receptacle in cross member 56. The arrangement and method of this embodiment is very similar to that of the previous embodiment, except for the fact that a pair of lines are used instead of a single line as shown in FIG. 1. Also, more cross members are illustrated to indicate the enhanced structural support for the framework of this embodiment.

This embodiment offers the advantage of providing a wider, elevated blanket area. As a result, the patient is provided with more lateral movement about the surface of mattress 20 without encountering the sides of blanket 36. The blanket is elevated a distance similar to that of the previous embodiment. This embodiment is particulary useful where the patient's foot problem requires that the upper part of his feet not encounter the blanket whatsoever.

The foregoing disclosure and description of the invention is illustrative and explanatory thereof, and various changes in the method steps as well as in the details of the illustrated apparatus may be made within the scope of the appended claims without departing from the spirit of the invention.

I claim:

1. A device for keeping a sheet or blanket off feet comprising:

a frame having a generally horizontal member and a vertical member, said horizontal member being attached to and extending from one end of said vertical member;

support means for maintaining said frame in a stationary position, said vertical member being connected to said support means; and a line extending from said frame and engaging said sheet or blanket, said line having a length sufficient to maintain said sheet or blanket in a position generally above said feet, said line attached to said horizontal member at one end, said line extending downwardly so as to engage said sheet or blanket, said line extending upwardly from said sheet or blanket and the other end of said line comprising a pin removably engaged a receptacle in said horizontal member, said line engaging said sheet or blanket so as to support said sheet or blanket a distance above and out of contact with said feet.

2. A method of keeping a blanket or sheet off the feet of a person in bed comprising:

fastening one end of the line to the hole of a pin;

fastening the other end of said line to a horizontal member extending generally above and parallel to said bed;

threading said pin and said line through a point on said blanket or sheet generally corresponding to the location of said feet;

drawing said thread and said blanket or sheet generally upwardly above said location of said feet; and inserting said pin into a receptacle on said horizontal member such that said blanket or sheet is maintained in a position out of contact with said feet.

3. The method of claim 2, further including the steps of:

placing a button about said blanket or sheet generally corresponding to said location of said feet; and threading said line through the holes of said button about said blanket or sheet.

* * * * *